United States Patent [19]

Limegrover

[11] 4,135,256

[45] Jan. 23, 1979

[54] FLOATING SWIMMING POOL

[76] Inventor: John K. Limegrover, 8112 Aber Rd., Verona, Pa. 15147

[21] Appl. No.: 777,608

[22] Filed: Mar. 15, 1977

[51] Int. Cl.[2] ..... A47K 3/00

[52] U.S. Cl. ..... 4/171

[58] Field of Search ..... 4/171, 172, 172.13, 4/172.14; 9/11

[56] References Cited

U.S. PATENT DOCUMENTS

| | | | |
|---|---|---|---|
| 208,360 | 9/1878 | Bamber | 4/171 |
| 2,825,910 | 3/1958 | Prudek | 4/172.13 |
| 3,026,538 | 3/1962 | Boyd et al. | 4/171 |

*Primary Examiner*—Harry N. Haroian
*Attorney, Agent, or Firm*—Howard I. Podell

[57] ABSTRACT

A swimming pool mounted externally of a floating ship or barge. A rectangular horizontal frame supports a walkway about an open rectangular area. A first outer net extending from below the outer borders of the walkway is mounted to telescopic vertical supports that are driven by gear motors to raise or lower the first net, and a second inner net extending from below the inner borders of the walkway is fixed about rollers suspended from the frame, with gear motors linked to the rollers to elevate or lower the second net by winding or unwinding the second net upon the rollers.

2 Claims, 6 Drawing Figures

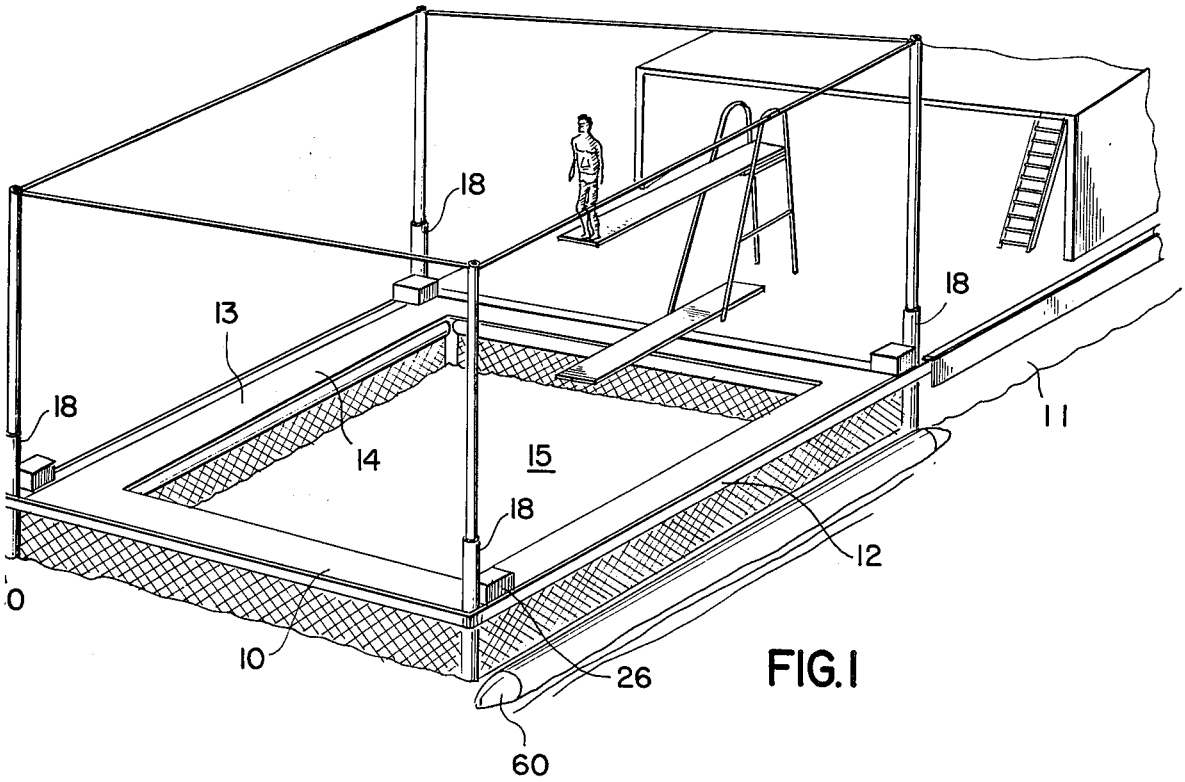
FIG. 1
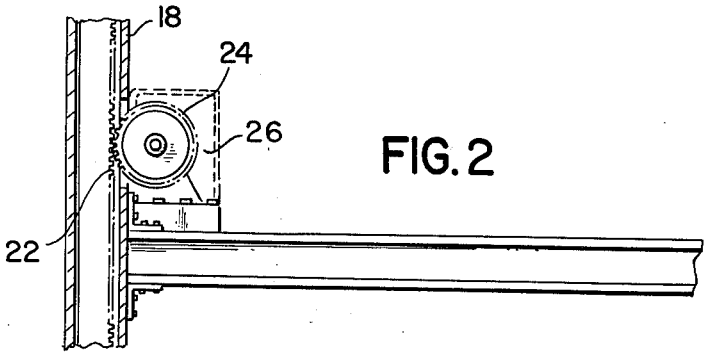
FIG. 2
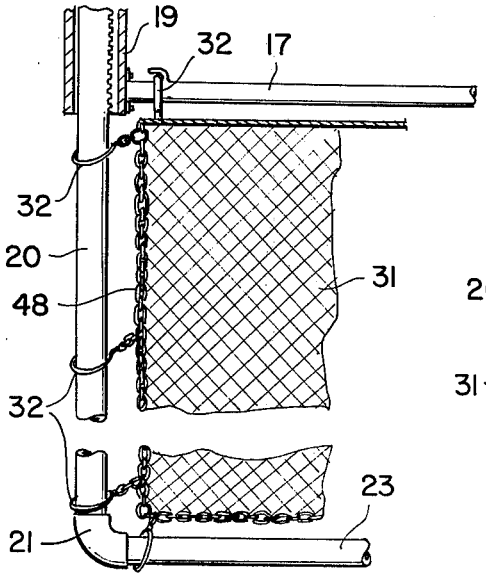
FIG. 3
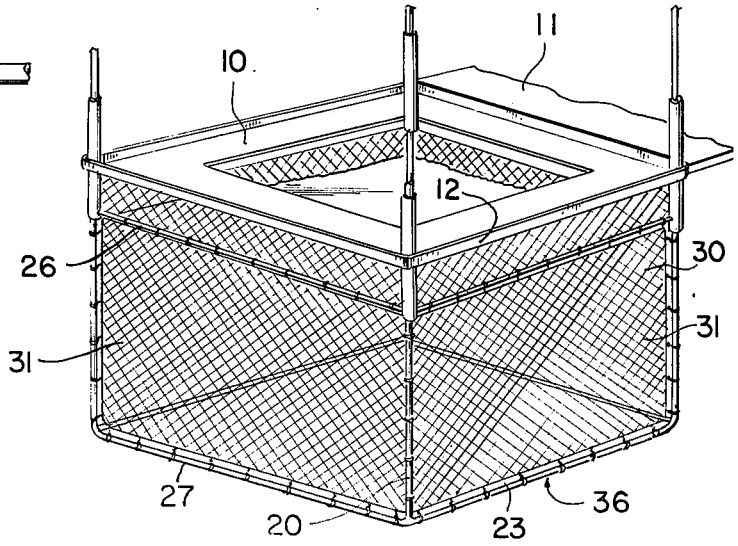

FIG.4
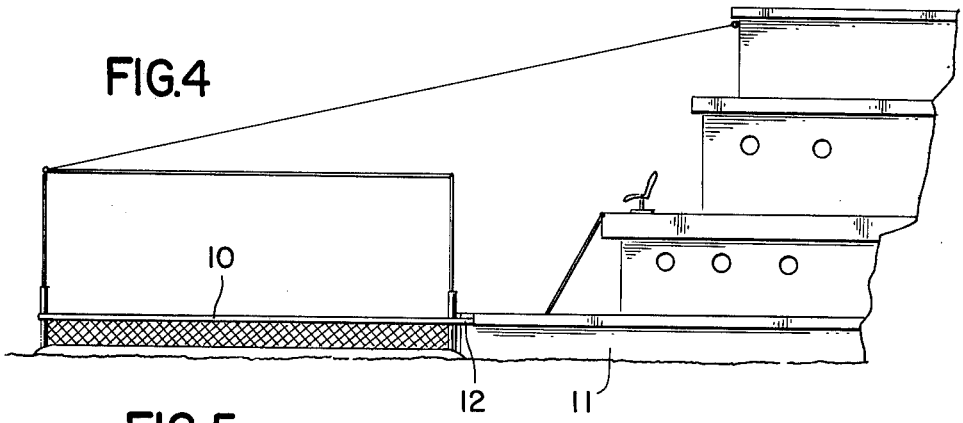
FIG.5
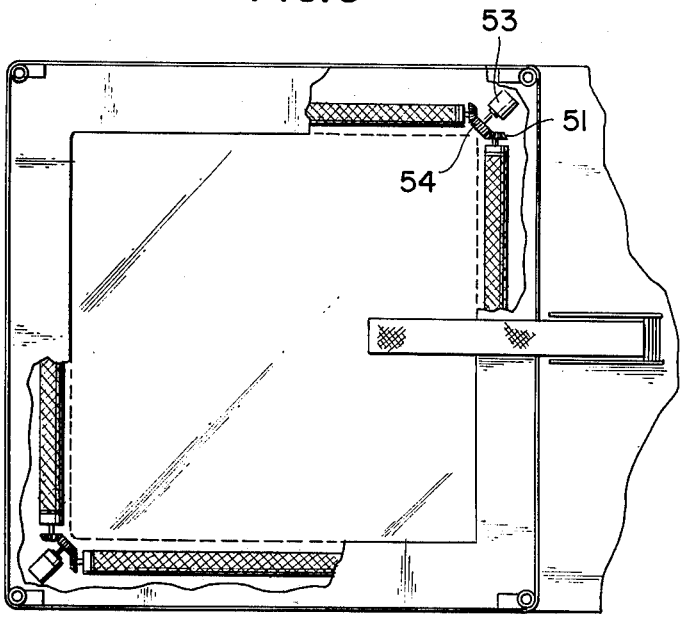
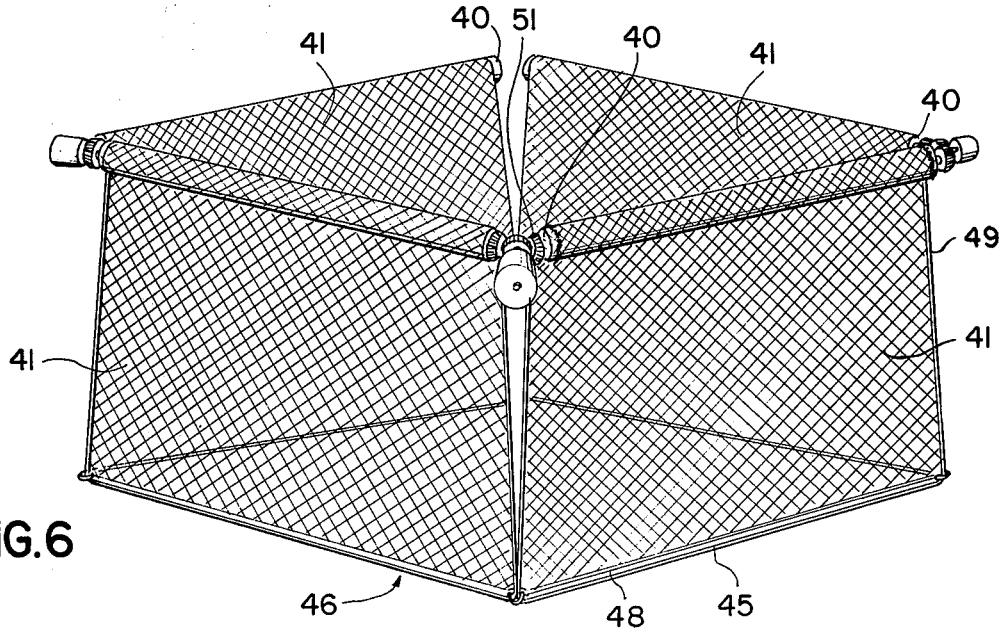
FIG.6

FLOATING SWIMMING POOL

SUMMARY OF THE INVENTION

My invention is a swimming pool mounted externally of a floating ship or barge. A rectangular horizontal frame supports a walkway about an open rectangular area. A first outer net extending from below the outer borders of the walkway is mounted to telescopic vertical supports that are driven by gear motors to raise or lower the first net, and a second inner net extending from below the inner borders of the walkway is fixed about rollers suspended from the frame, with gear motors linked to the rollers to elevate or lower the second net by winding or unwinding the second net upon the rollers.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a perspective view of the invention in use;

FIG. 2 is a detail elevation view of a rack gear fixed to a telescopic support of the outer net;

FIG. 3 is a perspective view of the outer net;

FIG. 4 is a side view of the invention;

FIG. 5 is a plan view of the invention; and

FIG. 6 is a perspective view of the inner net.

DESCRIPTION OF THE PREFERRED EMBODIMENT

Turning now descriptively to the drawings, in which similar reference characters denote similar elements throughout the several views, FIGS. 1 and 4 illustrate the retractable swimming pool unit 10 which is mounted externally of a floating ship 11 or barge.

A rectangular shaped open frame 12 extends horizontally from the side of ship 11 with a walkway 14 mounted on frame 12 to extend about an open enclosed area which serves as the swimming pool section 15.

A vertical hollow support tube 18 is fixed to each corner of the frame, with each tube 18 enclosing a telescopic vertical support member 20 to which an outer protection net 30 is fixed. A rack 22 is externally fixed to support member 20 to engage a gear 24 driven by an individual gear motor 26 mounted on the frame so as to elevate or lower support member 20. Each support member 20 is fixed at its lower end 21 to a pair of horizontal lower bars 23, with the four bars 23 joined to form a horizontal rectangular frame 27.

Each tube 18 is similarly fixed at its lower end 19 which may be near the water level, to a pair of horizontal top bars 17 which are oriented so that the four top bars 17 form a horizontal rectangular frame 26 above the lower rectangular frame 27. Flexible wire screening in the form of rectangular side panels 31 are joined to each opposed pair of side support members 20 and upper and lower bars 17 and 23 by slidable rings 32 and similar screening is joined by rings 32 to all four lower bars 23 to form a bottom panel 36, with panels 31 and 36 forming the sides and bottom of an outer shark protective cage for swimmers in the pool section 15.

A horizontal roller 40 is rotatably mounted under each of the four panels 13 of the walkway 14 to the frame with a flexible screen panel 41 fastened to each roller and with each panel 41 serving as a side of the swimming pool section 15. Each panel 41 is mounted at its lower end, as shown in FIG. 6, to one bar 45 of a rectangular open frame 48 to which a bottom screen panel 46 is fastened. A length of flexible chain 49 or cable may be fastened to each roller 40 adjacent each vertical edge of each side panel and extending to the corners of frame 48 so as to support frame 48 and bottom panel 46.

Each roller 40 is fixed to a bevel gear 51 that is engaged to a bevel gear 54 mounted to the drive shaft of a gear motor 53 located at an end of a roller 40 or at a corner of the frame, with motor 53 attached to the underside of frame 12, so that gear motors 53 may wind or unwind panels 41 to raise or lower the bottom panel 46.

Floating pontoons 60 may be fixed externally to outer upper bars 17 to serve as flotation supports, or such pontoons may be mounted under frame 12.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A swimming pool unit externally mounted to a floating ship, comprising a cage formed of side panels joined to a bottom panel, with said panels formed of a flexible screen material, said cage suspended from a rectangular shape open frame fixed externally to the ship, together with motorized means to lower the cage into the water to a desired depth of the bottom panel of the cage, in which each side panel of the cage is fastened to an individual roller mounted to and under the frame, upon which roller the side panel may be wound, with said rollers linked by mechanical means to said motorized means for winding or unwinding the side panels so as to raise or lower the cage respectively.

2. The combination as recited in claim 1 in which a second cage formed of side screen panels joined to a bottom screen panel is mounted to the frame externally of the said first cage, said second cage being suspended from the frame by telescopic support members linked to mechanical means for elevating or lowering of the said second cage, by retracting or extending said telescopic members respectively.

* * * * *